United States Patent [19]

Sveds

[11] Patent Number: 4,491,146

[45] Date of Patent: Jan. 1, 1985

[54] LIQUID LEVEL CONTROL

[75] Inventor: Paul Sveds, Skokie, Ill.

[73] Assignee: Groen Division/Dover Corporation, Chicago, Ill.

[21] Appl. No.: 421,371

[22] Filed: Sep. 22, 1982

[51] Int. Cl.[3] ..... F16K 49/00

[52] U.S. Cl. ..... 137/341; 137/392; 137/393; 307/118; 361/178; 219/324

[58] Field of Search ..... 60/667; 137/341, 392, 137/393; 307/118; 361/178; 219/324

[56] References Cited

U.S. PATENT DOCUMENTS

| | | | |
|---|---|---|---|
| 2,667,178 | 1/1954 | Fred et al. | 137/392 |
| 3,269,364 | 8/1966 | Higgins | 137/392 |
| 3,734,123 | 5/1973 | Pomerontz | 361/161 |
| 3,780,261 | 12/1973 | Eaton-Williams | 137/392 |
| 4,034,203 | 7/1977 | Cooper | 137/341 |
| 4,139,762 | 2/1979 | Pohrer et al. | 137/392 |
| 4,259,982 | 4/1981 | Bartels | 307/118 |

*Primary Examiner*—A. Michael Chambers

*Attorney, Agent, or Firm*—Robert E. Knechtel

[57] ABSTRACT

Improved apparatus for providing both a liquid level control and a low water cut-off for boilers and the like, having only a single probe and a single relay.

3 Claims, 1 Drawing Figure

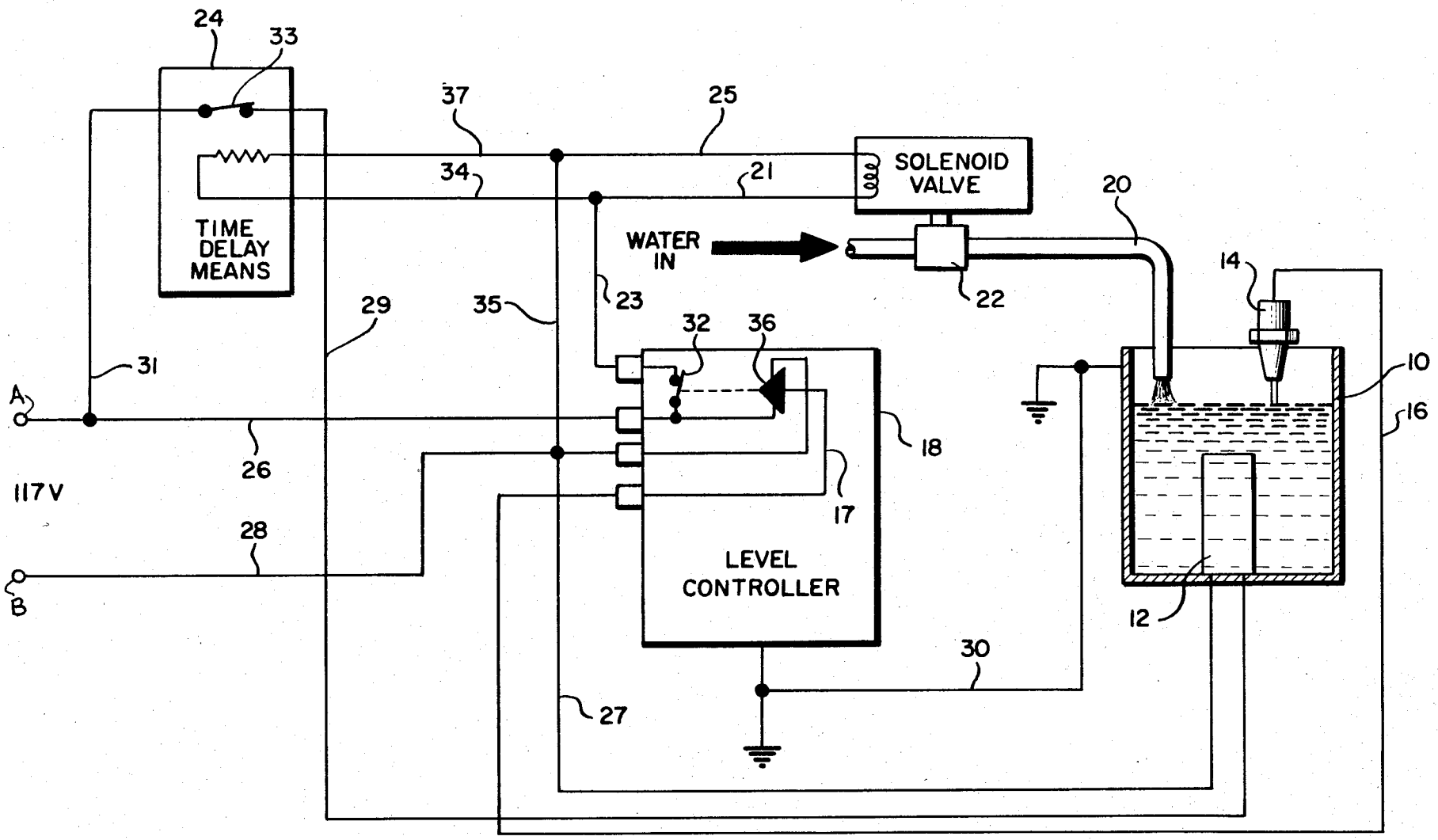
SOLENOID VALVE
WATER IN
LEVEL CONTROLLER
TIME DELAY MEANS
117 V
A
B
10
12
14
16
17
18
20
21
22
23
24
25
26
27
28
29
30
31
32
33
34
35
36
37

LIQUID LEVEL CONTROL

BACKGROUND OF THE INVENTION

This invention relates generally to a water feed system for boilers and the like and specifically, it relates to improved apparatus for providing liquid level control.

Control of liquid level in tanks, boilers, stills and the like, has largely been accomplished by float devices which, as the liquid level rises, operate to close a feed valve, or to throw a switch to cut off a feed pump. In the case of boilers and stills, it is a further requirement of any control system that it function to cut off the heat source (burners, electric heating elements, or the like) if the liquid level falls so low as to endanger the contained vessel or the heating source. In the case of boilers and stills under pressure or vacuum, these float systems also require that the float position be transmitted to the outside switch or feed valve through a packing gland or bellows, magnetic follower, or the like. With such arrangements, considerable trouble has resulted by reason of wear and variable friction and float hangups.

In recent years, such problems have been avoided by hanging electrically conducting probes down from above the liquid line into the liquid. Normally, three probes are used with the tip of one probe being placed at the highest desired water level so that when water contacts this probe a circuit is closed through a relay to shut off the feed system. A second probe has its tip positioned somewhat below the tip of the first probe, and is wired through another relay so that when the water level breaks from this probe, the feed pump or solenoid is turned on. The tip of the third probe extends lower than the tip of the second probe, and is wired so that when the water level breaks below this probe, the heat source (burner, heating elements and the like) is cut off so that no damage occurs. This latter cut off can automatically bring the heat source back on when water again contacts this lower probe, or a drop out can be inserted so that manual resetting is required. These systems require in addition to the three probes at least two special relays.

In view of the cost of these special relays and the three probes (with their fittings to get in to the boiler) some small boilers operating near atmospheric pressure have used a single probe together with a timer. With an arrangement such as this, when the water level breaks from the probe, it must stay continuously broken from the probe for a predetermined number of seconds, for example, approximately five seconds, after which the feed pump or valve is opened and feeding continues until the water level again rises to the probe. The purpose of the delay is to prevent over working the control system by reason of waves and splashing breaking contact with the probe even though the water is at a satisfactory level, and to allow the water level to drop appreciably before feeding. With single probe systems of this type only a single relay is required. For protection against overheating in the event that the water does not cover the boiler tubes, electrical heating elements and the like, other means such as temperature cut offs are used. The latter usually are much less costly than a second probe and relay. However, these temperature cut offs are much slower to act than a low water cut off probe and, in most cases, the fast reaction time of a probe is highly desirable.

Accordingly, it is an object of the present invention to provide a simple single probe, single relay control system that will stop the feed at maximum level, turn the feed on at a level below that, and quickly shut down the heat source at low water to prevent damage to the heated portions of the boiler.

An advantage of the control system of the present invention lies in the fact that a low water cut off is provided, but only a single probe and single relay are required.

Generally, the single probe, single relay control system of the invention is connected and arranged to:

1. Turn off the water feed when the water level reaches the probe;

2. Turn on the water feed after the water level has broken below the probe for a predetermined period, typically, five seconds;

3. If the water rapidly rises to the probe after having broken from the probe, the feed is turned off, ending the normal cycle; and 4. If the water, after having broken from the probe does not rise again to the probe in a second predetermined time period, typically ten seconds, the heat source is shut down. The heat source can be locked out or an alarm energized, if such a condition occurs.

BRIEF DESCRIPTION OF THE DRAWING

FIG. 1 is a schematic block diagram illustrating the single probe, single relay control system of the invention.

DESCRIPTION OF PREFERRED EMBODIMENT

Referring now to the drawing, a liquid containing vessel 10 is illustrated and this vessel 10 may be a tank, a boiler, a still or the like. A heat source 12 which may be a submerged element, as illustrated, or other means such as an external gas flame is provided for heating the liquid in the vessel 10. A conventional probe 14 such as an Auburn level probe is installed within the vessel 10 in such a manner that when the liquid is up to the desired level in the vessel 10 it contacts the probe 14. The probe 14 is coupled by means of conductors 16 and 17 to a time delay relay 36 of a liquid level controller 18 which may be, for example, a liquid level controller manufactured by General Time, Model No. 9989-3OZ-455A01, or its equivalent. Liquid is fed into the vessel 10 through a conduit 20, under the control of a normally closed solenoid valve 22. The time delay relay 36 has a normally closed contact 32, and is powered through the probe 14 to open the contact 32, when the water in the vessel contacts the probe. An external time delay relay 24 having a normally closed contact 33 is provided, and it is powered through contact 32 of the liquid level controller 18.

OPERATION

Starting with the vessel empty, input voltage is applied to the terminals A and B. Power flows through conductor 26, contact 32, conductors 23 and 21 to the solenoid valve 22 to energize it. The solenoid valve 22 opens, feeding water to enter the vessel 10. Power also flows through conductor 26, contact 32, conductors 23 and 34 to the time delay means 24, to start its timing. In addition, power flows through conductor 31, contact 33, conductor 29, to energize the heat source 12. If the water level in the vessel 10 does not reach the probe 14 within the time delay period of the time delay relay 24, typically 10 seconds the contact 33 of the time delay means 24 opens and cuts off the power to the heat source 12.

When the water level reaches the probe 14, the time delay relay 36 in the liquid level controller 18 is energized and opens its contact 32, thereby de-energizing the solenoid valve 22 to shut off the water entering the vessel 10. When the contact 32 opens, the time delay means 24 also is de-energized so that contact 33 closes and energizes the heat source 12.

Thereafter, so long as the liquid supply is adequate, the operation is as follows. As evaporation occurs in vessel 10 and the liquid falls, it breaks away from probe 14 and the time delay relay 36 is de-energized. If the break is brief, as by a liquid wave, so power through the probe 14 is quickly restored to the time delay relay 36, the delay, typically 5 seconds, prevents closing of the contact 32 during this time delay period. But if the liquid break from the probe 14 persists beyond this time delay, time delay relay 36 will time out, closing contact 32 and starting the sequence described above in energizing the defined solenoid 22, and the time delay relay 24. This sequence will go to completion provided the liquid feed is fast enough to reach probe 14 before the time delay relay 24 times out, opening its contact 33.

However, if the liquid supply is inadequate, the operation is as follows:

After liquid has broken from probe 14 for a period long enough for the time delay relay 36 to time out and close its contact 32 and the resulting liquid feed to the vessel 10 is stopped or so slow that time delay relay 24 then times out (typically 10 seconds on small vessels), contact 33 opens and the heat source 12 is turned off. If desired, alarms can be energized, or the operation locked out requiring a manual reset to start. If the system is not locked out, and if liquid finally again rises to the probe 14, the feed will be shut down and the heat source energized, as described above. Thus, low liquid cut off of the heat source is accomplished and the vessel and heat source is protected against overheating.

Accordingly, from the above description, it can be seen that an improved apparatus for providing both a liquid level control and a low water cut off of the heating source is provided, using only a single probe and a single relay. This apparatus furthermore provides all of the advantages of the conventional three probe systems, yet is far less expensive. As compared to the single probe systems using a liquid level controller with internal timer and with separate temperature cut-off devices, the apparatus of the invention provides a much faster reaction time, which normally is desirable and needed in industry.

What is claimed is:

1. A liquid level control system for liquid containment vessels and the like having heating means associated therewith for heating the liquid contained therein, said system comprising, in combination:

control means;

sensing means associated with said vessel for detecting the presence or absence of liquid at an established height in said vessel and for generating a control signal which is coupled to said control means;

valve means for controlling the feeding of liquid into said vessel;

delay means for controlling the operation of said heating means; said valve means and said delay means being coupled to said control means and controlled by said control means in accordance with the control signal generated by said sensing means;

the operation being such that said valve means is operated to feed liquid into said vessel when said sensing means detects the absence of liquid at the established height in said vessel and to operate said valve means to cut off the feed of liquid into said vessel when said sensing means detects the presence of liquid at the established height in said vessel, and such that said delay means is operated to cut off said heating means when said sensing means detects the absence of liquid at the established height in said vessel for an established time period.

2. The liquid level control system of claim 1, wherein said delay means is operated to cut off said heat source within an established period of time after said valve means is operated to feed liquid into said vessel if said sensing means fails to detect the presence of water at the established height in said vessel within that established period of time.

3. The liquid level control system of claim 1, wherein said valve means is operated by said control means to feed liquid into said vessel only after an established period of time after said sensing means detects and couples a control signal to said control means indicating the absence of liquid at the established height in said vessel.

* * * * *